US005309957A

United States Patent [19]

Saisuu

[11] Patent Number: 5,309,957

[45] Date of Patent: May 10, 1994

[54] FUEL DISPENSING APPARATUS CAPABLE OF AUTOMATICALLY DISCRIMINATING FUEL SORT

[75] Inventor: Yasushi Saisuu, Yokohama, Japan

[73] Assignee: Tatsuno Corporation, Tokyo, Japan

[21] Appl. No.: 45,205

[22] Filed: Apr. 13, 1993

[30] Foreign Application Priority Data

Apr. 13, 1992 [JP] Japan ..... 4-119657
Oct. 1, 1992 [JP] Japan ..... 4-286848

[51] Int. Cl.[5] ..... B65B 1/30; B65B 3/26

[52] U.S. Cl. ..... 141/83; 141/96; 141/392; 141/196; 141/DIG. 1; 73/24.05

[58] Field of Search ..... 141/83-94, 141/95, 96, 392, 192, 198, DIG. 1, 196; 73/24.01, 24.05, 24.06

[56] References Cited

U.S. PATENT DOCUMENTS 4,503,703 3/1985 Pagel ..... 73/24.01
4,796,678 1/1989 Motohashi et al. ..... 141/198
5,209,275 5/1993 Akiba ..... 141/83

FOREIGN PATENT DOCUMENTS 3-133797 6/1991 Japan .
2189999 3/1992 Japan .

*Primary Examiner*—Henry J. Recla

*Assistant Examiner*—Steven O. Douglas

[57] ABSTRACT

A fuel dispensing apparatus for automatically discriminating a sort of fuel in a fuel tank of a vehicle in advance of fuelling, by sucking the fuel vapor in the tank into a chamber provided on a fuelling nozzle and accomodating a gas sensor for sensing the vapor introduced into the chamber. The nozzle is further provided with an air ejecter having a base port communicated with an air supplying means through an air hose, a top port for ejecting the air from the base port toward the atmosphere when it is opened, and a side port connected with the gas sensor chamber. A valve body is movably arranged in the nozzle and moved in a forward direction by a nozzle lever and in a backward direction by a pressure of fuel supplied to the nozzle so as to open and close the top port of the air ejector. When the nozzle lever is pulled after the nozzle is inserted into the fuel tank, the valve body is moved in the forward direction to open the top port to the atmosphere, which results in generating negative pressure in the gas sensor chamber which sucks the vapor in the fuel tank into the chamber so as to determine whether the fuelling is allowed or not, and when the valve body is moved backward by the fuel pressure during the fuelling operation, the top port is closed so that the air from the ejector is directed to the gas sensor chamber to sweep the vapor away from the chamber.

6 Claims, 9 Drawing Sheets

FUEL DISPENSING APPARATUS CAPABLE OF AUTOMATICALLY DISCRIMINATING FUEL SORT

TECHNICAL FIELD OF THE INVENTION AND RELATED ART

The invention relates to a fuel dispensing apparatus adapted to automatically discriminate a sort of fuel, above all gasoline or light oil, by sucking fuel vapor left in a fuel tank of the vehicle to be refuelled so as not to dispense an erroneous fuel when a fuelling nozzle muzzle is inserted into a filler pipe connected with the fuel tank.

As well known, there are two sorts of fuel to be usually supplied to a motor vehicle such as an automobile, namely usual gasoline and light oil or gas oil for the diesel engine. When gasoline should have been dispensed erroneously for the diesel engine, the so-called "knocking" occurs even if the engine can be driven. When light oil should have been supplied erroneously for the gasoline engine, the fuel having a fairly higher viscosity can not be fed well to the engine in case of carburettor type, while, in case of injector type, the engine can not be started at a lower temperature and the engine is to be sintered at a higher temperature. At any rate the fuel sort must be definitely distinguished in the gasoline stations.

The fuel dispensing apparatus as referred to at the beginning and having been actually used for a fairly long time has a gas sensor arranged in the main body of the apparatus to which fuel vapor is fed by a suction pump which is also arranged in the main body from the tip of the fuelling nozzle inserted in the vehicle fuel tank through a long hose. Not only it takes a fairly long time untill fuel sort distinction is made possible, but also a fairly strong power is necessary for such suction pump.

The inventors, thus, proposed to provide the gas sensor chamber in the fuelling nozzle so as to make the time far shorter and the pump fairly smaller. This type of the fuel dispenser has been actually used, but is not always satisfactory in that misjudgement on the fuel sort may be caused due to eventually left in the gas sensor chamber, because when fuel supply is started, the suction pump is stopped so that necessary sweeping air possibly containing vapor of fuel dispensed at the last time out of the sensor chamber and air conduit can be done only for a few seconds from taking off the nozzle from a nozzle hook to pulling a nozzle trigger.

SUMMARY OF THE INVENTION

It is an object of the invention is, thus, to provide a fuel dispensing apparatus adapted to completely sweep air eventually containing vapor of fuel dispensed at the last time out of a gas sensor chamber and concerned conduit so as to always correctly discriminate the sort of fuel to be dispensed.

Another object is to provide the fuel dispensing apparatus as referred to above, in which a volume of fuel to be dispensed is preset so that fuel dispensing is automatically stopped when a volume of fuel actually dispensed reaches the preset volume.

Still other object is to provide the fuel dispensing apparatus just referred to above, in which even if the nozzle is left to be inserted in the vehicle fuel tank after the fuel dispensing is automatically stopped, suction of fuel vapor can not be done which may deteriorate the gas sensor but air sweeping is made.

The objects can be attained fundamentally by using not a suction pump but an air supply pump arranged in the main body of the apparatus so that air supplied into the fuelling nozzle under pressure is used for generating negative pressure on the one hand and on the other hand for sweeping air out of the gas sensor and concerned conduits, and by using a change-over valve actuated by a nozzle lever to be triggered and fuel pressure to be increased.

The above last two objects can be attained according to the second embodiment of the invention mainly by improving the change-over valve.

DETAILED DESCRIPTION OF PREFERRED EMBODIMENTS

Figure 1:
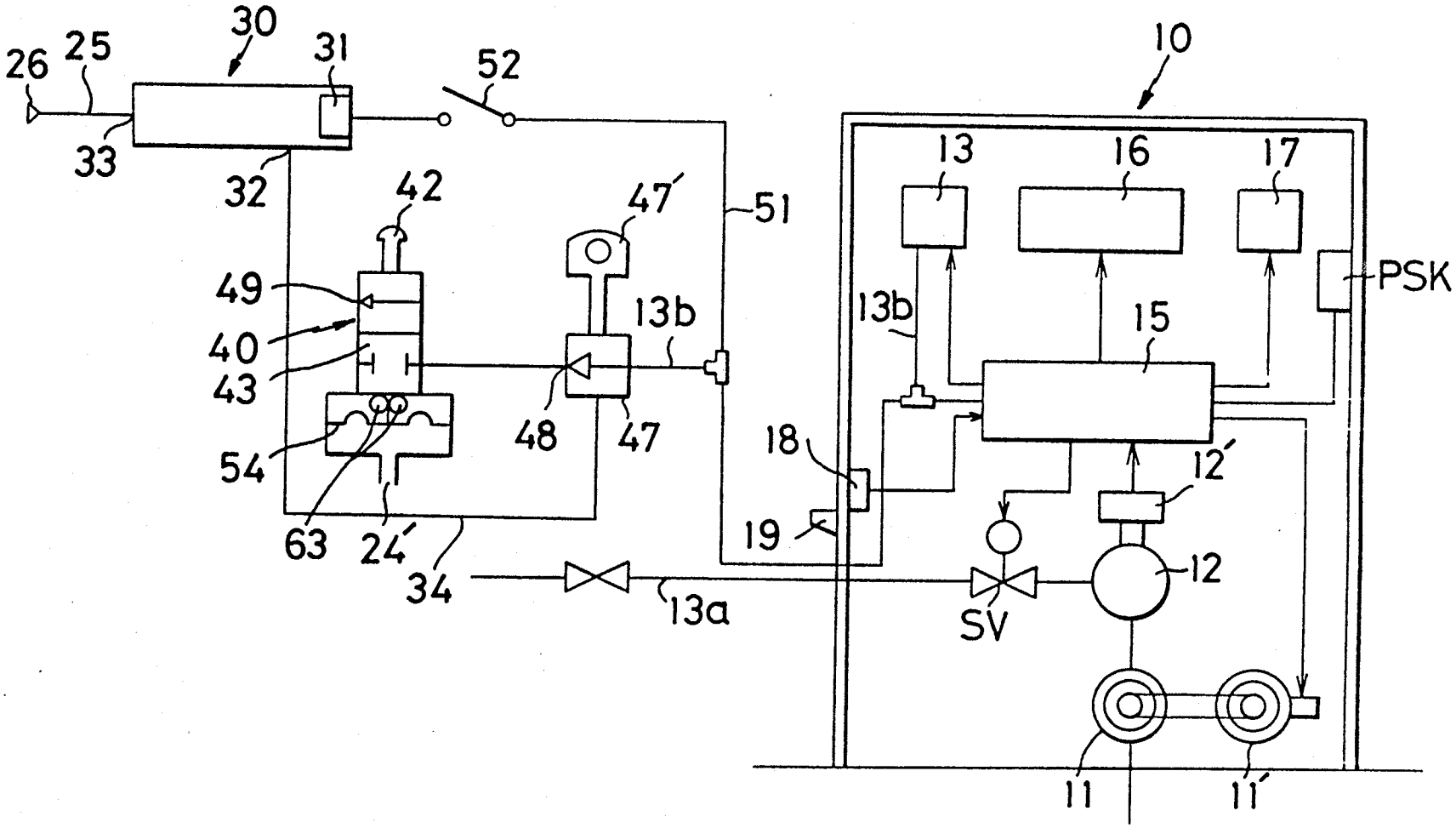
FIG. 1 is a block diagram showing a preferred embodiment of the fuel dispenser capable of discriminating a fuel sort according to the invention.
Figure 2:
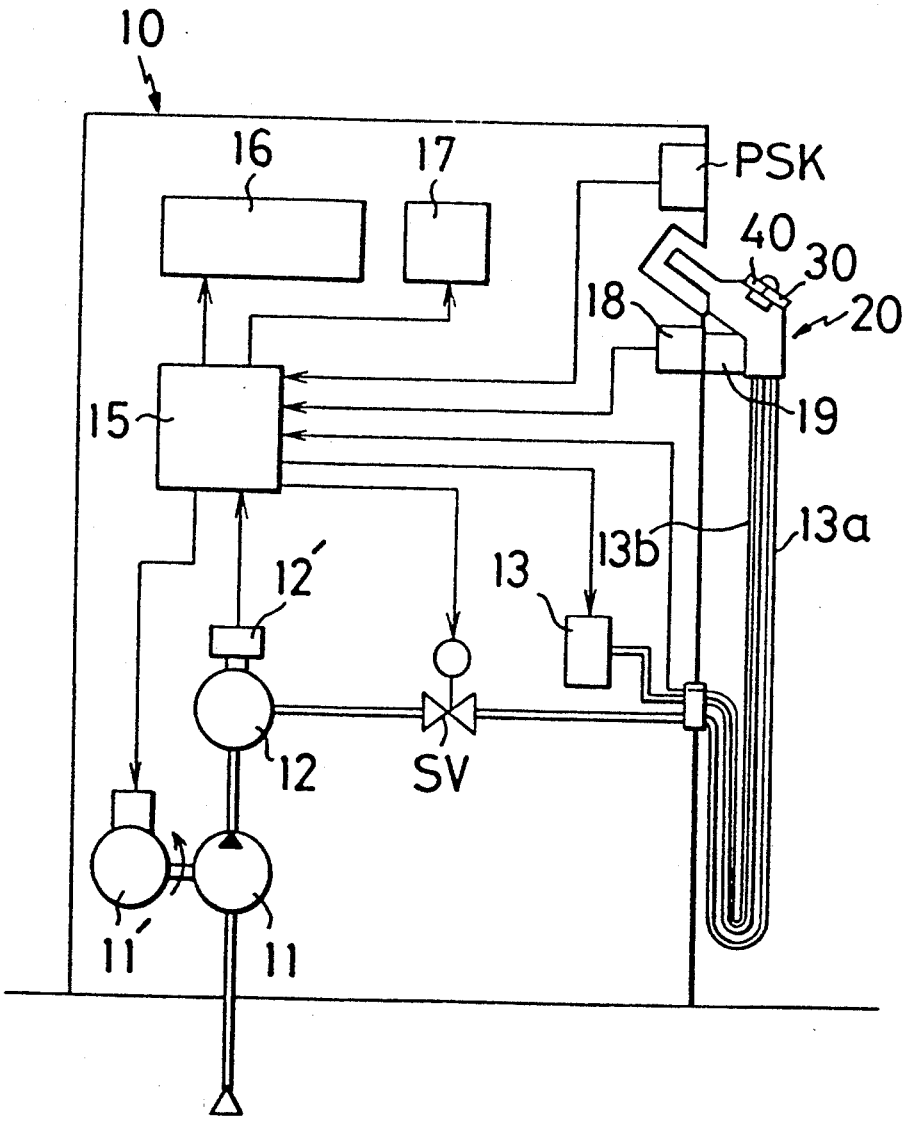
FIG. 2 is a diagram of the right half in FIG. 1 a little more virtually.

In reference to FIG. 1, a fuel dispenser main body represented generally by 10 is shown at the right, while a gas sensor chamber 30 and a change-over valve 40 mounted on a fuelling nozzle 20 is shown at the left and in FIG. 2 showing the main body 10 only, the main body 10 of the fuel dispenser comprises a pump 11 driven by a motor 11' for feeding fuel in the underground reservoir not shown up to the fuelling nozzle 20 through a flow meter 12 and a fuel hose 13*a*. The main body 10 further comprises an air pump 13 for supplying air to the nozzle 20 through an air hose ₁3*b*, of which purpose is for sweeping air possibly containing vapor of fuel dispensed at the last time out of the gas sensor chamber 30 and for introducing the vapor in the fuel tank into the gas sensor chamber 30 to be explained in more detail later.

There is provided in the main body 10 further a controlling device 15 for processing a fuel flow pulse signal from a pulse transmitter 12' so as to be shown on an indicator 16 connected therewith as numerical figures. The controlling device 15 is stored with a fuel sort datum to be compared with a fuel sort signal from a gas sensor 31 in the chamber 30 via a cable 51 and a switch 52 so that when coincidence is judged, the fuel pump 11 may be driven, but when such judgement is not outputted after the lapse of a predetermined time, a warning device 17 is actuated and the motor 11' is not driven.

There is provided further a microswitch 18 connected with the controlling device 15 so that when the nozzle 20 is taken off from a hook 19, the nozzle switch 18 is actuated so that the controlling device 15 is in a state for driving the air pump 14.

Figure 3:
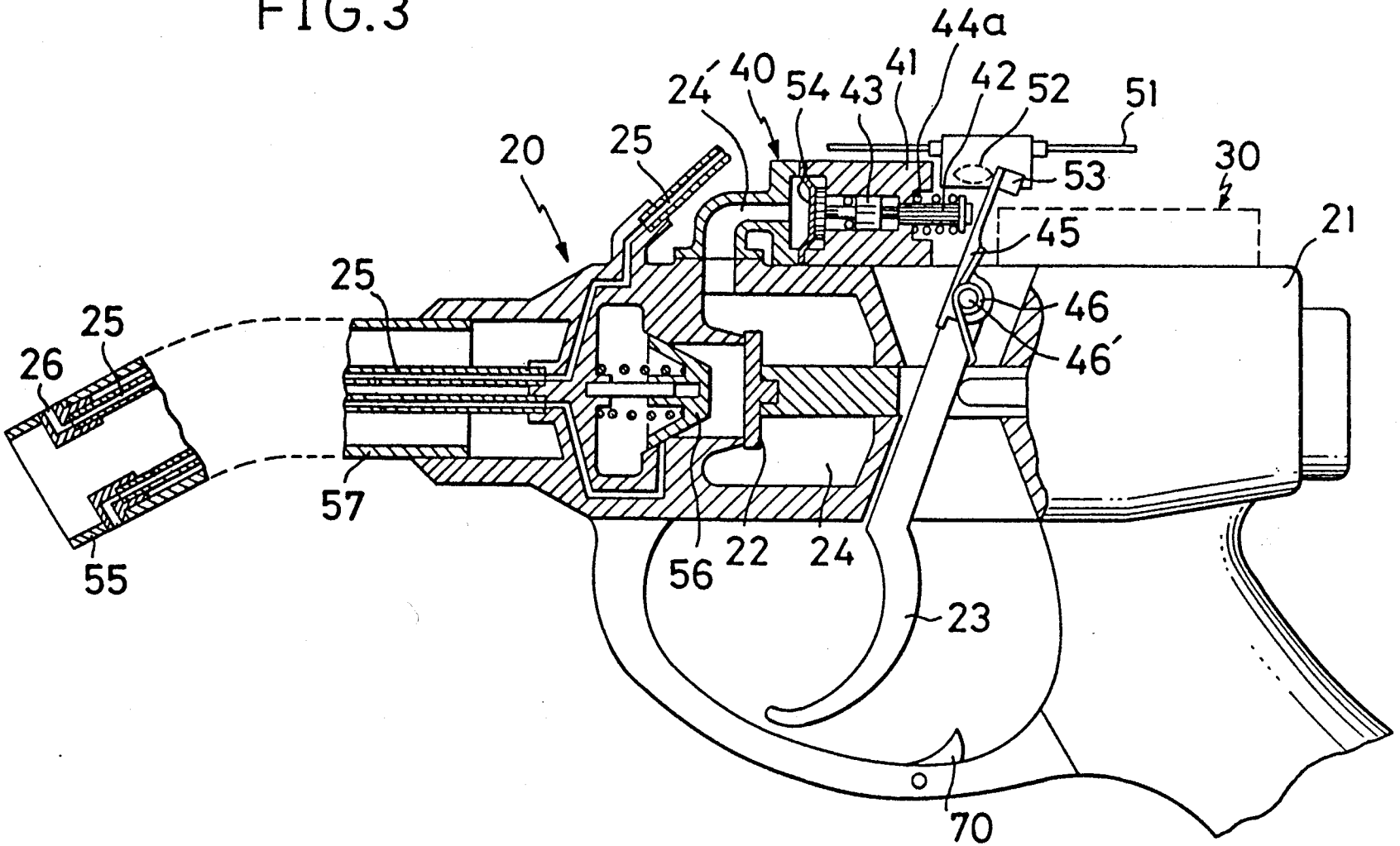
FIG. 3 is a side view partly shown in section of a fuelling nozzle used in the dispenser of the invention.
Figure 4:
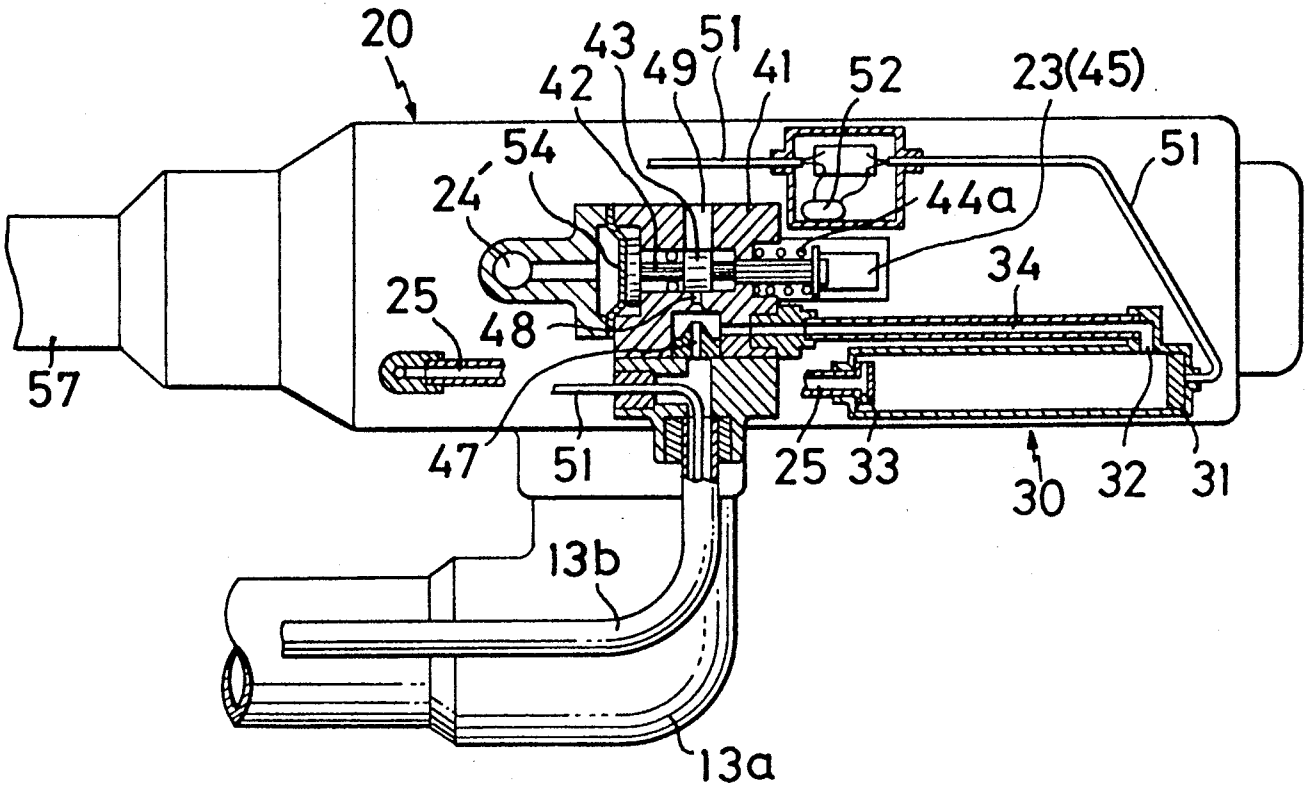
FIG. 4 is a plan view partly in section of the above fuelling nozzle.

Now in reference to FIGS. 3 and 4, the fuelling nozzle 20 has a barrel 21 which comprises a main valve 22 mounted therein to be opened by pulling a nozzle lever or trigger 23 against the force of a spring not shown so as to allow fuel filled in a main valve chamber 24 to pass through a nozzle portion of the nozzle 20 and rush into a fuel tank of the vehicle not shown, as usual.

There are mounted on the barrel 21 the gas sensor chamber 30, the change-over valve 40 and a switch 52 according to the invention.

The gas sensor chamber 30 preferably in the form of a cylinder has the gas sensor 31, e.g. a supersonic wave transducer (see FIG. 4 and also FIG. 1) at one end, where a first opening 32 is formed for introducing air into the chamber 30. The cylindrical chamber 30 has a particular length for propagation of supersonic wave and a second opening 33 for sucking fuel vapor into the chamber 30 at the other end thereof, which is connected through a duct 25 with an opening 26 formed at the tip of the nozzle 20.

The change-over valve 40 has a peripheral wall 41 and a valve rod 42 fixedly mounted with a valve body 43 so as to be axially movable between a first position shown in FIGS. 3 and 4, and a second position a little left therefrom in the drawings. A coiled compression spring 44*a* is extended on and along the valve rod 42 so as to keep the valve body 43 in the illustrated first position.

An arm 45 is pivoted on a pivot pin 46' for the nozzle lever 23 and forced by a spring 46 so as to extend normally in alignment therewith. The free end of this arm 45 abuts on the concerned end of the valve rod 42. The spring 46 is mounted at one end on the end of the trigger 23 and at the other end on the concerned end of the arm 45 so that when the trigger 23 is pulled, the arm 45 is also angularly moved, whereby the valve rod 42 and consequently the valve body 43 is moved from the first position to the second position.

A diaphragm 54 is arranged between the other end of the valve rod 42 and an end of a bypass 24' connected with the main valve chamber 24. When the chamber 24 is filled with fuel, the diaphragm 54 is urged by a higher pressure of fuel towards the switch-over valve 40 against the force of the spring 46 even if the trigger 23 is being pulled so as to move the rod 42 and the valve body 43 to the first position, where the arm 45 is bent relative to an extended line from the nozzle lever 23.

As shown in FIG. 4 and also in FIG. 1, there is provided an air ejector 47 in the peripherable wall 41 having an air ejecting port 48 so as to be closed by the valve body 43 in the illustrated first position. The ejector 47 has an opposite port open to the air hose 13*b* at the end thereof and a side port connected with the first or inlet opening 32 of the gas sensor chamber 30 through an air tube 34. The peripheral wall 41 is formed with a groove 49 opposite to the air ejecting port 48. When the valve body 43 is in the first position so as to close the ejecting port 48, air under pressure, which is supplied from the air pump 13 through the air hose 13*b* to the opposite port of the ejector 47, is compelled to pass through the side port of the ejector, and the opening 32 to flow into the gas sensor chamber 30 for sweeping air therein possibly containing fuel vapor out of the chamber 30, which is exhausted therefrom through the outlet opening 33, the duct 25 and the tip opening 26 into the atmosphere. In FIG. 1, 47' shows a sight glass provided in the ejector 47 for visually monitoring the charged air.

When the valve body 43 is brought in the second or open position by actuation of the trigger 23, air supplied in the ejector 47 under pressure may pass through the ejecting port 48 and the groove 49 now connected therewith so as to burst into the atmosphere, whereby negative pressure is generated at the side port of the ejector and the air tube 34 so as to suck fuel vapor in the vehicle fuel tank from the tip opening 26 through the duct 25, the second opening 33 into the chamber so that the supersonic wave transducer as the gas sensor 31 determines fuel vapor concentration based on the wave propagation time.

When the nozzle lever 23 is triggered for starting to dispense fuel, the arm mounted with a magnet 53 at the free end, is also angularly moved so that the magnet 53 passes by the microswitch 52 mounted on the nozzle barrel 21 near the change-over valve 40 so that the switch 52 is turned ON, whereby a pulse signal given from the controlling device 15 through the cable 51 so as to actuate the sensor 31 and an echo signal caused thereby is given to the controlling device. The cable 51 is preferably extended in the air duct 13*b*.

Figure 5:
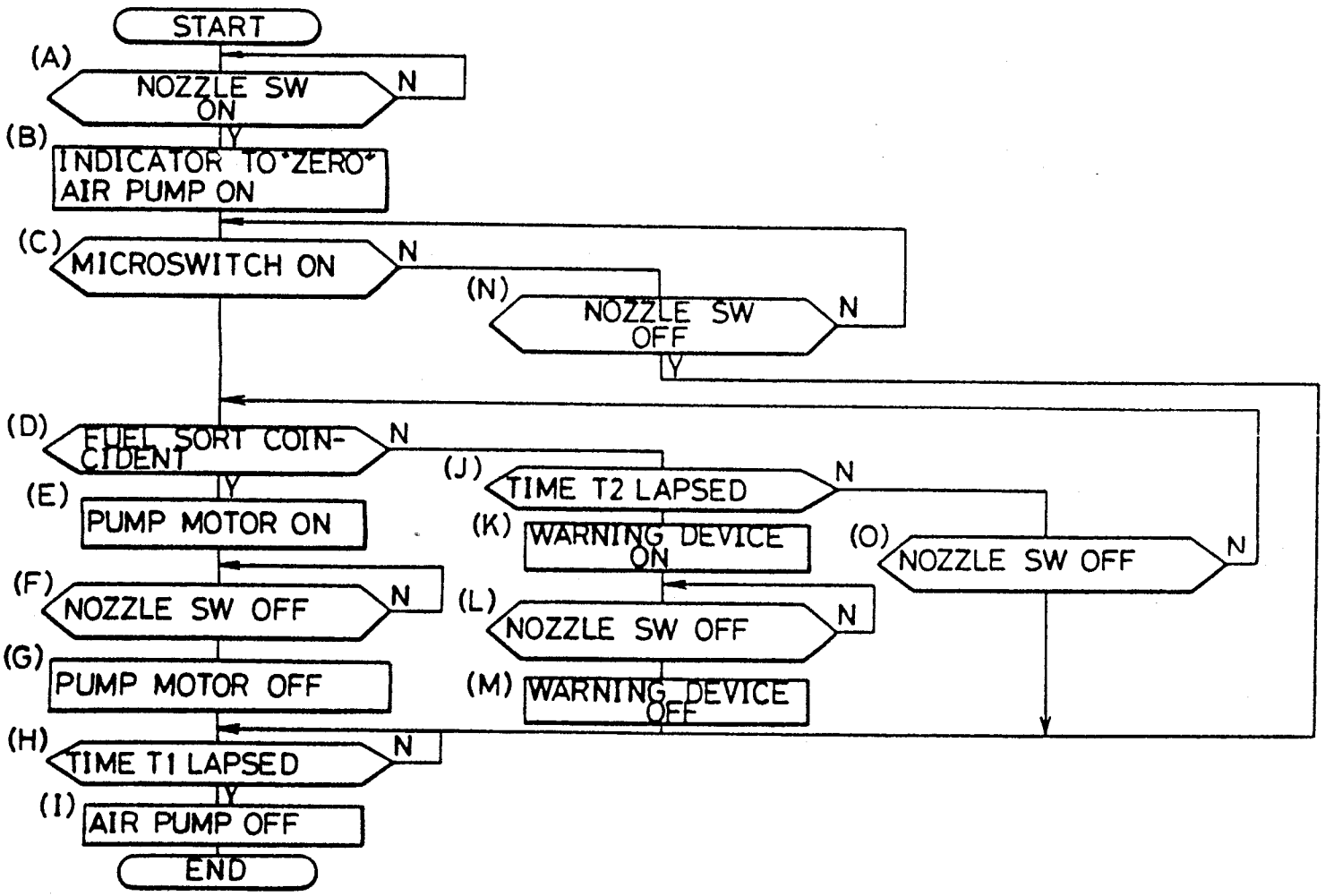
FIG. 5 is a flow chart showing operation of the fuel dispenser of the invention.

Now in operation of the fuel dispenser as referred to above referring to FIG. 5, when taking off the nozzle 20 from the hook 19, the nozzle switch 18 is turned ON (Step A) so that the indicator 16 is reset to "zero" and the air pump 13 is driven (Step B). Since the nozzle lever 23 is not yet triggered on this step, the main valve is retained in the closed position, and the change-over valve body 43 is in the first or close position, so that air fed from the air pump 13 through the air hose 13*b* passes the air tube 34 for sweeping air in the chamber 30 possibly containing fuel vapor therefrom and exhauseted out of the tip opening 26 into the atmosphere.

When inserting the tip of the nozzle 20 into the vehicle fuel tank and triggering the nozzle lever 23, the magnet 53 mounted at the free end of the angularly moving arm 45 passes by the microswitch 52 to be turned ON (Step C), and the change-over valve body 43 is moved to be in the second or open position for ejecting air into the atmosphere through the groove 49 so as to generate negative pressure in the air tube 34 and consequently in the chamber 30, whereby fuel vapor in the vehicle fuel tank is sucked through the tip opening 26 and the duct 25 into the chamber 30.

Owing to turn ON of the microswitch 52, signal for actuating the supersonic wave transducer as the gas sensor 31 is given from the controlling device 15 through the cable 51 so as to determine a vapor concentration in accordance with the wave propagation time. Any other gas sensor, e.g. a semiconductor gas sensor may be used instead of the supersonic wave transducer. The fuel sort is judged in the controlling device 15 by comparing the signal given from the gas sensor 31 through the switch 52 and the cable 51 with the datum stored therein, and when the result is coincidence (Step D), the pump motor 11' is energized for driving the fuel pump 11 (Step E) so that fuel is fed into the nozzle 20 and discharged from the tip end 55 of the nozzle 20 into the vehicle fuel tank through the opened main valve 22, a subsidiary valve 56 and a nozzle portion 57. The increased pressure of fuel in the main valve chamber 24 and the bypass 24' influences the diaphragm 54 whereby the valve body 43 is brought again in the first or close position, against the force of the spring 46, with angularly moving the arm 45 with respect to the nozzle lever 23 which is being pulled, as a result of which the ejecting port 48 is closed so that air under pressure sweeps the sensor chamber 30 during the fuel is dispensed.

When a predetermined volume of fuel has been dispensed, the nozzle lever 23 is released to be in the orginal position and the nozzle 20 is hung up on the hook 19 so as to turn the nozzle switch 18 OFF (Step F), whereby the pump motor 11' is deenergized (Step G) and fuel dispensing is stopped. After a predetermined time T1 necessary for completely sweeping air out of the chamber 30, e.g. 5 seconds lapsed (Step H), the air pump 13 is stopped (Step I).

When the judgement on the fuel sort should not be outputted despite of the lapse of a predetermined time T2, e.g. 2 seconds (Step J), warning lamp or buzzer is energized or a message for instance "Return Nozzle on Hook And Confirm Fuel Sort" is given by the warning device 17 (Step K), according to which the nozzle 20 is hung on the hook 19 so that the nozzle switch 18 is turned OFF (Step L) and the warning device 17 is deenergized (Step M). Then the Steps H and I are repeated.

When erroneous fuel sort is found immediately after the nozzle 20 has been taken off from the hook 19 or during the controlling device 15 is judging the fuel sort, the nozzle 20 is hung on the hook 19 so as to turn the nozzle switch 18 OFF (Step N or Step O), whereby the air pump 14 is driven to sweep air in the chamber 30 and the air tubes 34, 25 for the time T1 (Step H) and then the air pump 13 is stopped (Step I).

Now the second embodiment of the invention is to be explained hereafter, which intends to preset a volume of fuel dispensed so that when the dispensed fuel volume reaches at the volume preset and stored in the controlling device 15, the fuel dispensing is automatically stopped.

However, according to the first embodiment in which the change-over between the air sweeping out of the gas sensor chamber 30 and the fuel vapor sucking into the chamber 30, i.e. between supplying air to the chamber 30 and supplying air to the ejector 47 so as to generate negative pressure in the chamber 30 for sucking fuel vapor, relies on the pressure of the fuel filling in the chamber 24 and the bypass 24', undesirable situation as follows may be caused. Since the fuel dispensing is automatically stopped, the nozzle is apt to be left inserted in the car fuel tank even after the fuel pump is stopped, during which vapor sucking into the sensor chamber 30 is still continued. When the gas sensor 31 is exposed to the vapor for so long time and so often, the use life of the sensor may be shortened and the measurement accuracy may be deteriorated.

In order to avoid such undesirable results, the structure of the change-over valve 40 is changed as shown in FIGS. 6A, 6B, 7A and 7B. So far as FIGS. 1 to 4 are concerned there is no essential difference between the two embodiments, except that in FIGS. 1 and 2 a preset key board PSK is provided for presetting a volume of fuel to be dispensed which is stored in the controlling device 15 to which a volume of fuel being dispensed is inputted every moment from the flow meter 12 through the flow pulse signal transmitter 12' and that a solenoid valve SV is provided in the fuel hose **13*a* and connected with the controlling device 15 so as to be actuated for opening thereby together with the motor 11' and the air pump 13**.

In FIGS. 3 and 4, the change-over valve 40 are of course changed as shown in FIGS. 6A, 6B, 7A and 7B respectively in larger scales, but similar members are represented by numerical figures used in FIGS. 3 and 4.

Figure 6A:
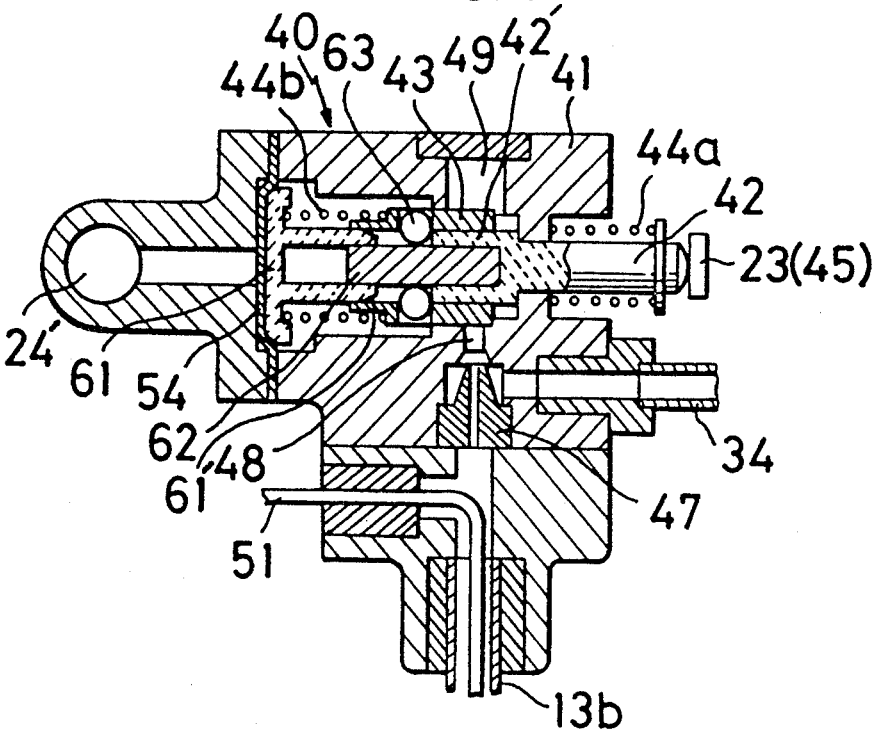
FIGS. 6A and 6B are sectional views of the same and one change-over valve arranged in the fuelling nozzle according to the second embodiment of the invention, respectively in a state of sweeping air possibly containing vapor of fuel dispensed at the last time out of a gas sensor chamber and in a state of sucking fuel vapor.

The change-over valve 40 has the peripheral wall 41 and the valve rod 42 is axially movable in the bore formed by the wall 41 and slidably mounted with the valve body 43 which is in the first position in FIG. 6A so as to close the ejecting port 48 so that air supplied under pressure through the air hose **13*b* is compelled to flow through the side port of the ejector 47 and the tube 34 into the gas sensor chamber 30** not shown here for sweeping air containing fuel vapor.

Figure 6B:
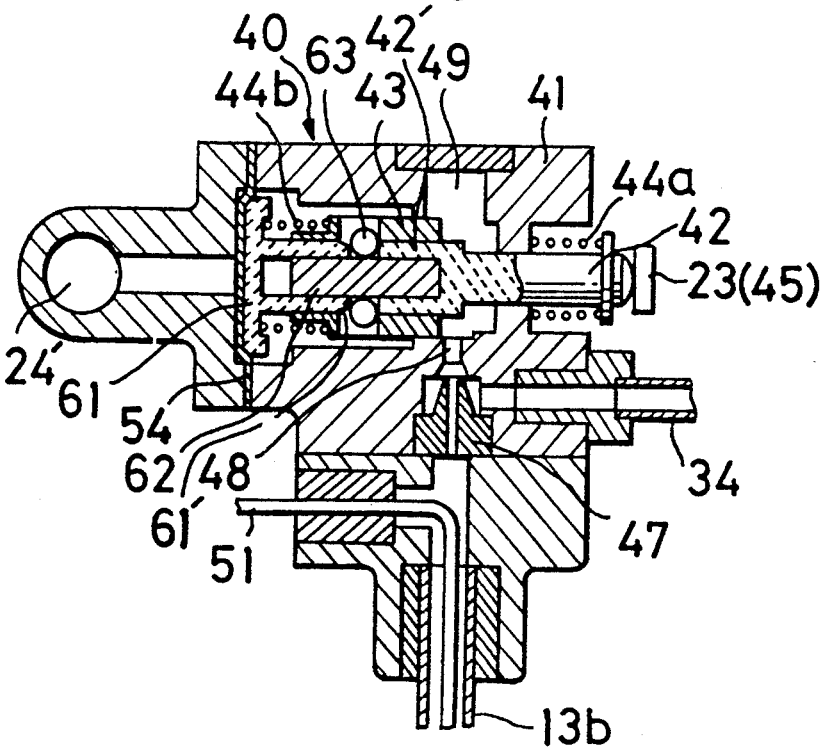

The outer end of the valve rod 42 is to be pushed inwards when triggering the nozzle lever 23 so that the valve body 43 is brought in the second position as shown in FIG. 6B where the passage for the air ejector 47 is opened so as to generate negative pressure for fuel vapor suction, similar to the first embodiment.

At the left side of the change-over valve 40, there is provided also the diaphragm 54, but when the pressure of fuel in the bypass 24' is increased, what is influenced by the inwardly flexed diaphragm is not the rod 42 but an axially movable hollow cylinder member 61 separatetherefrom. The valve rod 42 in this embodiment is integrally provided with a hollw cylinder 42' at the inner end, which has a cylindrical magnet 62 fixed inserted therein, while the hollow cylinder member 61 may be axially and inwardly moved so that the free end of the cylindrical magnet 62 is snugly fitted in the hollow cylinder 61.

Between the peripheral free end of the axially movable member 61 and the peripheral inner end of the valve rod 42, there are circumferentially arranged a plurality of balls 63 of magnetic material to be attracted around the cylindrical magnet 62. When the hollow cylindrical member 61 is urged to the right in the drawing by the diaphragm 54, the tapered peripheral end 61' of the member 61 pushes the balls 63 radially outwards against the magnetic force so as to abut now on the opposite peripheral end of the valve body 43 to be in the first position (From FIG. 6B to FIG. 7A).

Figure 8:
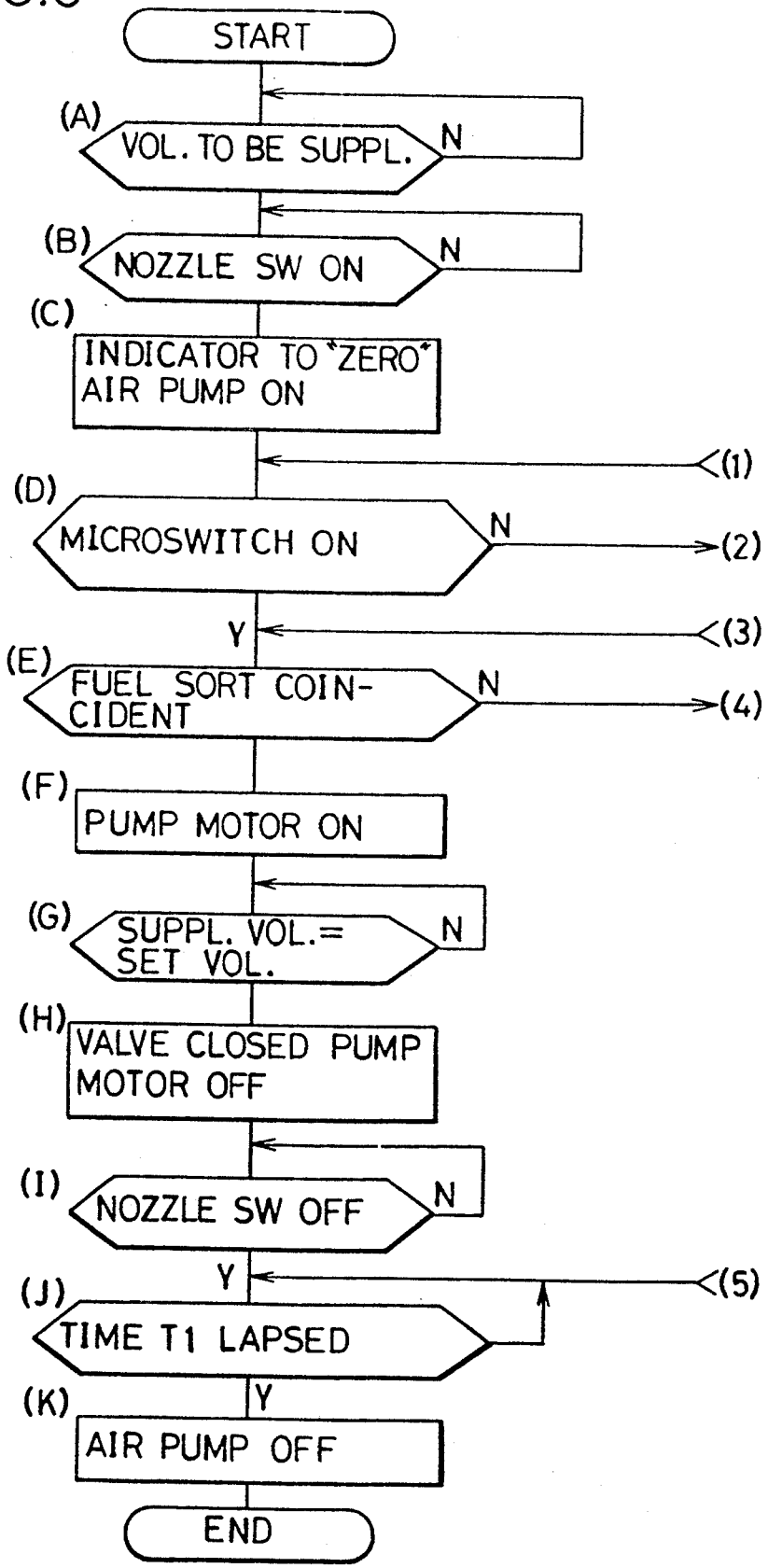
FIG. 8 is a flow chart showing operation of the second embodiment.
Figure 9:
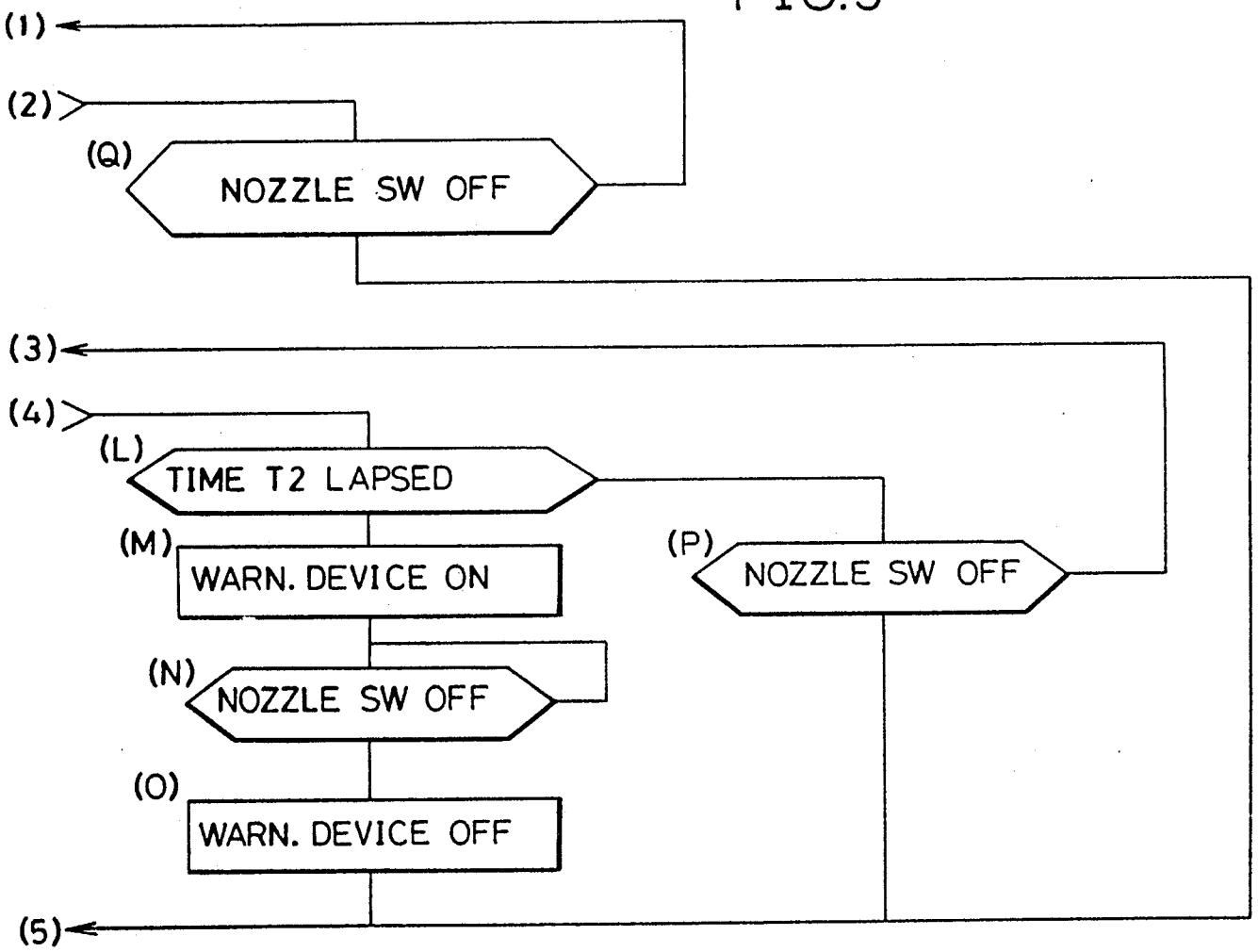
FIG. 9 is a similar view but showing operation in case where it has been found that erroneous sort of fuel is to be dispensed.

Now in operation of the second embodiment of the invention referring to FIG. 8, when actuating the preset key board PSK so as to preset a volume of fuel to be dispensed (Step A) and taking off the nozzle 20 from the hook 19 so as to turn the nozzle switch 18 ON (Step B), the indicator 16 is reset to "zero" and the air pump 13 is driven to start fuel dispensing (Step C). Since on this step the nozzle lever 23 is not yet triggered so that the main valve 22 is still closed, the change-over valve body 43 is in the first position where the air ejector 47 is closed (FIG. 6A) so that air supplied under pressure from the air pump via the air hose **13*b* is compelled to flow through the side port of the ejector 47 and the tube 34 into the chamber 30** for air sweeping.

When inserting the nozzle 20 into the vehicle fuel tank and triggering the nozzle lever 23 which is then engaged with a latch 70, the magnet 53 mounted on the arm 45 angularly moved together with the nozzle lever 23 on the common pivot pin 46' passes by the microswitch 52, whereby it is turned ON and concurrently the change-over valve body 43 is brought in the second position for connecting the air ejecting port 48 with the groove 49 (FIG. 6B) (Step D). Thus, the ejector 47 generates negative pressure in the tube 34 and the chamber 30 so as to suck fuel vapor in the vehicle fuel tank from the nozzle tip opening 26 into the gas sensor chamber 30.

Figure 7A:
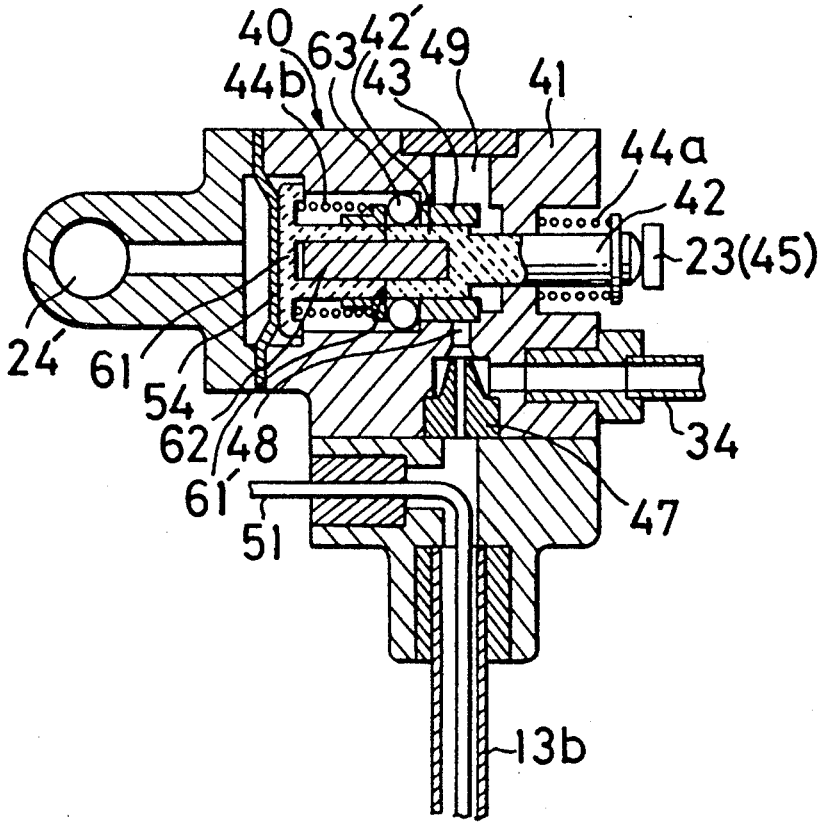
FIGS. 7A and 7B are similar views but respectively in a state of fuel dispensing and in a normal state where fuel is not dispensed.
Figure 7B:
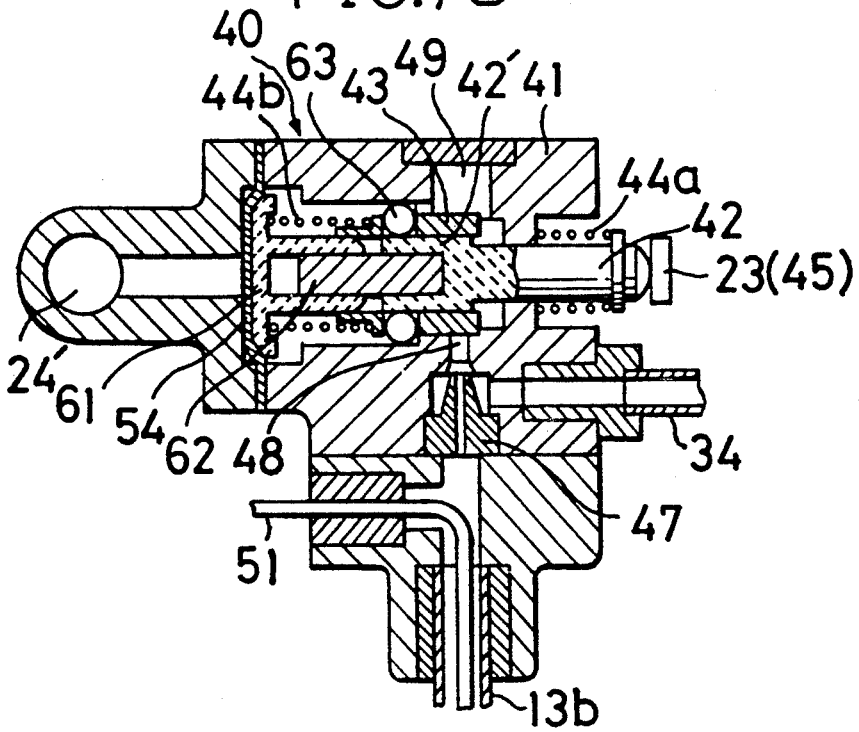

Owing to turning ON of the microswitch 52 as referred to above, the gas sensor 31 is actuated by a signal given from the controlling device 15 via the cable 51. When the fuel sort datum in the form of vapor concentration is given to the controlling device 15 and it confirms that the fuel sorts are coincident (Step E), the pump motor 11' is energized by the controlling device 15 to start fuel dispensing (Step F). Thus, the pressure of fuel in the main valve chamber 24 and the bypass 24' is increased so as to influence the diaphram 54 to be yeldingly flexed inwards, which urges the hollow cylindrical member 61 to axially move towards the opposite hollow cylinder portion 42' of the rod 42 so that a tapered peripheral end 61' of the former pushes the plurality of balls 63 radially outwards to abut on the peripheral end of the cylinder 42' of the rod 42 and urges the valve body 43 to be in the first position by the force of the spring 44*b*, whereby air sweeping is continued during fuel dispensing (FIG. 7A).

When the volume of fuel actually dispensed reaches the volume to be dispensed preset and stored in the controlling device 15 (Step G), the solenoid valve SV (FIG. 1) is closed and the pump motor 11' is deenergized respectively by the controlling device 15 so as to stop fuel supply to the nozzle 20. Since the pressure of fuel is, thus, decreased, the diaphragm 54 is urged to the original position owing to the spring 44*b*, but the valve member 43 is still left in the position due to the force of the spring 44*b* (FIG. 7B) so that air sweeping is continued for preventing fuel vapor from entering the gas sensor chamber 30 through the tip end opening 26 of the nozzle eventually left to be inserted in the vehicle fuel tank, even after fuel dispensing has been automatically stopped.

When the concerned person who has noticed the fuel-dispensing-stop takes off the nozzle 20 out of the vehicle fuel tank and releases the nozzle lever 23 from the latch 70 to angularly move to the normal position owing to the spring force, the valve rod 42 freed from urging by the arm 45 may move rightwards in the drawing to return to the normal position whereby the change-over valve 40 restores the orginal position shown in FIG. 6A. When the nozzle 20 is hung on the hook 19, the nozzle switch 18 is turned OFF (step I). When a predetermined time T1, e.g. five seconds lappes after that (Step J), the air pump 13 is stopped by the controlling device 15 so that air sweeping for the gas sensor chamber is also stopped (Step K).

Meanwhile, in the (Step E) when the controlling device 15 can not output the result that the fuel sort is coincident after a predetermine time T2, e.g. two seconds (Step L), it is adapted to actuate the warning device 17 so that e.g. a message "Return Nozzle On Hook, Confirm Fuel Sort" is given (Step M), according to which the nozzle 20 is hung on the hook 19 so that the switch 18 is turned OFF (Step N) and the warning device 17 is deenergized (Step O).

Then, the air pump 13 is driven so as to sweep air in the sensor chamber 30 and the air tube 25 untill the time T1 lapses so as to sweep vapor out of the sensor chamber 30 and the tube 25 (Step J), after which the air pump 13 is stopped (Step K in FIG. 8).

When the concerned person notices that erroneous fuel is going to be dispensed immediately after taking off the nozzle 20 from the hook 19 or during the fuel sort judging, he will return the nozzle 20 on the hook so that the switch 18 is turned OFF (Step Q or Step P). In these cases, also the air pump 13 is driven for the air sweeping until the predetermined time T1 lapses after that.

In the above embodiment, the explanation has been made on the case where the volume of fuel to be dispensed is preset to be stored in the controlling device, but this can be used, of course, for the dispenser adapted to be automatically stopped when the vehicle fuel tank is fully filled.

What is claimed is:

1. A fuel dispensing apparatus capable of discriminating a sort of fuel, comprising a main body which is provided with means for supplying air under pressure to a fuelling nozzle which is formed with an opening at the tip end thereof and comprises a gas sensor chamber communicating with said opening and having a gas sensor contained therein, means connected to said chamber for allowing supplied air to burst into the atmosphere through an air ejecting port so as to generate negative pressure in the chamber connected thereto, and a change-over valve connected to said means having a rod fixedly mounted thereon with a valve body which is movable between a first position where said air ejecting port is closed thereby so that supplied air is compelled to flow into the gas sensor chamber for sweeping air contained therein and a second position whereby said air ejecting port is opened so that fuel vapor may be sucked from said gas sensor chamber by said generated negative pressure so that the gas sensor may identify a fuel sort by virtue of particular properties thereof.

2. The fuel dispensing apparatus as set forth in claim 1, characterized in that said change-over valve has a coiled spring extended on and along the valve rod so as to hold the valve body in the first position; that an arm is pivoted on a pivot pin for a nozzle lever so as to be normally held in alignment with the nozzle lever by means of a spring so that the free end of the arm may abut on the outer end of the valve rod; and that when triggering the nozzle lever the arm may be angularly moved together therewith so as to bring the valve body to be in the second position; while a diaphragm is connected at the other end of the valve rod so that when pressure of fuel in the fuelling nozzle is increased, said diaphragm may be yieldingly flexed inwards so as to bring the valve body back to said first position.

3. The fuel dispensing apparatus as set forth in claim 2 and capable of presetting a volume of fuel to be dispensed so that when the volume of fuel dispensed reaches the preset volume the fuel dispensing is automatically stopped, characterized in that the valve rod is intergrally mounted with a hollow cylinder having a cylindrical magnet fixedly inserted therein at the inner end thereof, the valve body in the form of a cylinder being slidingly mounted on the hollow cylinder; that a hollow cylindrical and axially movable member is arranged so that the bottom thereof faces toward the diaphragm and a hollow cylinder thereof may be snugly fitted with the free end portion of said cylindrical magnet; that a plurality of balls of magnetic material are arranged around the cylindrical magnet to be attracted thereby and between the ends of said two hollow cylinders opposite with each other, the balls being adapted to connect the valve body to the hollow cylinder and push the hollow cylindirical member according to the forward movement of the valve rod when the balls are in contact with the magnet but, when the balls are departed from the magnet, the valve body is freed and slidingly movable with respect to the hollow cylinder; and that in addition to said coiled spring extended on and along the valve rod, there is provided a second coiled spring extended between the hollow cylindrical member and the valve body, whereby, when the valve rod is pushed forward by the nozzle lever through the arm, the valve body in the first position is accompanied therewith by the aid of the balls which are in contact with the magnet so that the valve body is brought to the second position and the air ejecting port is opened to the atmosphere, and when the diaphragm is flexed inwards due to increased fuel pressure, the hollow cylindrical member is urged to axially moved so that a tapered peripheral free end thereof pushes the plurality of balls radially outwards so as to bring the balls on the peripheral surface of the hollow cylindrical portion of the rod, whereby the valve body is slidingly moved on the hollow cylinder toward the first position by the force of the second coiled spring so that the air ejecting port is closed by the valve body and air in the gas sensor chamber is continuously swept during the fuel dispensing and also after the fuel dispensing is automatically stopped.

4. The fuel dispensing apparatus as set forth in claim 2, characterized in that said negative pressure generating means is an air ejecter having a base port connected with an air hose extended from air supplying means arranged in the main body; a top port for ejecting air and a side port connected with the gas sensor chamber through a conduit so that, when air bursts into the atmosphere, negative pressure may be generated in the conduit and the gas sensor chamber for vapor suction.

5. The fuel dispensing apparatus as set forth in claim 2, characterized in that a chamber filled with fuel and having a main valve which is opened by triggering the nozzle lever so that fuel therein may be supplied under pressure is connected with a bypass to which said diaphragm is faced so as to thereby cause said diaphragm to yield due to increased pressure of fuel in communication therewith.

6. The fuel dispensing apparatus as set forth in claim 2, characterized in that when the diaphragm is yielding flexed so as to bring the valve rod and consequently the valve body into the first position, the arm may be angularly moved despite the nozzle lever being triggered.

* * * * *